United States Patent [19]

Simson

[11] Patent Number: 4,466,576

[45] Date of Patent: Aug. 21, 1984

[54] METERING DRUM FOR FILAMENTARY MATERIAL

[75] Inventor: Dionizy Simson, Winterthur, Switzerland

[73] Assignee: Sulzer Brothers, Winterthur, Switzerland

[21] Appl. No.: 345,422

[22] Filed: Feb. 3, 1982

[30] Foreign Application Priority Data

Mar. 9, 1981 [EP] European Pat. Off. ..... 81810087.7

[51] Int. Cl.[3] ..... B65H 51/20

[52] U.S. Cl. ..... 242/47.01; 139/452; 226/175; 226/191; 279/1 Q; 279/2 R

[58] Field of Search ..... 242/47.01, 47.03, 47.04, 242/47.05, 47.06, 47.07, 47.08, 47.09, 47.12, 47, 46.4, 72 R, 68.2; 139/452; 226/175, 168, 174, 190, 191; 279/1 Q, 2 R

[56] References Cited

U.S. PATENT DOCUMENTS

| | | | |
|---|---|---|---|
| 2,341,636 | 2/1944 | Luehrs | 226/175 |
| 2,390,168 | 12/1945 | Piot | 242/46.4 X |
| 3,197,153 | 7/1965 | Davidson | 242/46.4 X |
| 3,243,975 | 4/1966 | Lawson et al. | 242/47.01 X |
| 3,377,824 | 4/1968 | Moyer | 242/47.01 X |
| 3,650,447 | 3/1972 | Muka | 226/175 X |
| 4,227,657 | 10/1980 | Simin et al. | 242/47.01 |
| 4,238,080 | 12/1980 | Van Mullekom | 242/47.01 X |
| 4,239,066 | 12/1980 | Takahashi | 242/47.01 X |
| 4,320,786 | 3/1982 | Popp | 139/452 |

FOREIGN PATENT DOCUMENTS

| | | | |
|---|---|---|---|
| 2007271 | 9/1971 | Fed. Rep. of Germany | 226/175 |
| 133782 | 1/1979 | Fed. Rep. of Germany | 226/175 |

*Primary Examiner*—Stanley N. Gilreath

[57] ABSTRACT

The metering drum for the weft thread of a weaving machine has a circumferential surface of rubber which is clamped between two supporting rings. The supporting rings may be movable axially or rotatably relative to each other so as to expand or constrict, respectively, the rubber surface in order to change the length of the thread windings. The rubber surface may also be expanded by means of a pressure medium within a chamber between two fixed supporting rings.

1 Claim, 8 Drawing Figures

METERING DRUM FOR FILAMENTARY MATERIAL

This invention relates to a metering drum for a filamentary material. More particularly, this invention relates to a metering drum for delivering filamentary material to a weaving machine.

As is known, various types of machines have been known which require the delivery of predetermined lengths of filamentary material. For example, it has been known that weaving machines require measured lengths of weft thread for the production of textile fabrics. In such cases, use has been made of various devices for measuring or for adjusting the length of a weft thread being supplied to a working point of the weaving machine. One known device, for example as described in German O.S. No. 29 11 864, employs a winding element in the form of a conical drum and a thread guide at the circumference of the drum to receive axially offset turns of the weft thread from the drum. The thread guide is displaceable in an axial direction so that the length of each thread turn can be changed when moved into a different region of the conical drum. In this manner, for example in a weaving machine with air jet insertion of the weft thread into a shed, the length of the weft thread to be inserted can be adapted to the width being woven.

In order to change the length of each single turn of weft thread in the above noted device, the thread turns must be axially displaced or moved during operation. However, this may lead to tensions in the thread which may cause the thread to rupture within the weaving machine. Further, large friction may result at the thread guide in each turn so that the thread becomes stressed in an undesirable manner. Still further, a thread guide which is axially displaceable must be arranged at the circumference of the conical drum.

Accordingly, it is an object of the invention to provide a metering device of relatively simple and reliable construction.

It is another object of the invention to provide a metering device which does not require a separate thread guide.

It is another object of the invention to provide a metering device wherein the length of a thread winding can be readily varied.

It is another object of the invention to provide a metering device which does not require axial movement of thread windings in order to change the length of a thread delivered from the drum.

Briefly, the invention provides a metering drum for a filamentary material which has a circumferential surface for receiving at least one winding of the filamentary material and in which at least a part of the surface is elastic for varying the circumferential dimension of the surface. The construction of the device is such that the circumferential dimension can be varied so that the length of each winding can be varied in a simple manner without displacement or movement of the windings axially. As a result, the filamentary material can be treated in a very gentle manner.

Since the circumferential dimension of the elastic part of the metering drum can be varied, there is no need for an axially displaceable thread guide adjacent to the metering drum. However, if a thread guide, for example consisting of several eyelets or of a comb, is used, the guide may be fixedly mounted to serve only to separate the individual windings from each other.

The metering drum may employ various means for deforming the elastically deformable circumferential surface in order to vary the circumferential dimension. In one embodiment, wherein the deformable surface is defined by an annular elastic sleeve, the deforming means includes a pair of coaxial supporting rings disposed to either side of the sleeve. At least one of these rings is adjustable relative to the other in order to change the diameter of the sleeve. For example, one ring may be axially movable relative to the other ring in order to circumferentially expand the sleeve or may be rotatably movable relative to the other ring in order to constrict a central portion of the sleeve.

In another embodiment, the deforming means includes a pair of coaxial supporting rings to opposite sides of the elastically deformable sleeve in order to define a chamber, a pressure medium in the chamber and means for displacing the pressure medium within the chamber in order to expand the sleeve.

In still another embodiment, the elastically deformable surface may be defined by an annular sleeve which is slidably mounted on a tapered section of a drive shaft in mating relation while the deforming means includes a pair of coaxially movable supporting rings for shifting the sleeve axially of the tapered section.

These and other objects and advantages of the invention will become more apparent from the following detailed description taken in conjunction with the accompanying drawings wherein:

FIG. 1 illustrates a cross-sectional view through a metering device constructed in accordance with the invention;

FIG. 1*a* illustrates a view similar to FIG. 1 of a modified metering device constructed in accordance with the invention;

Figure 1:
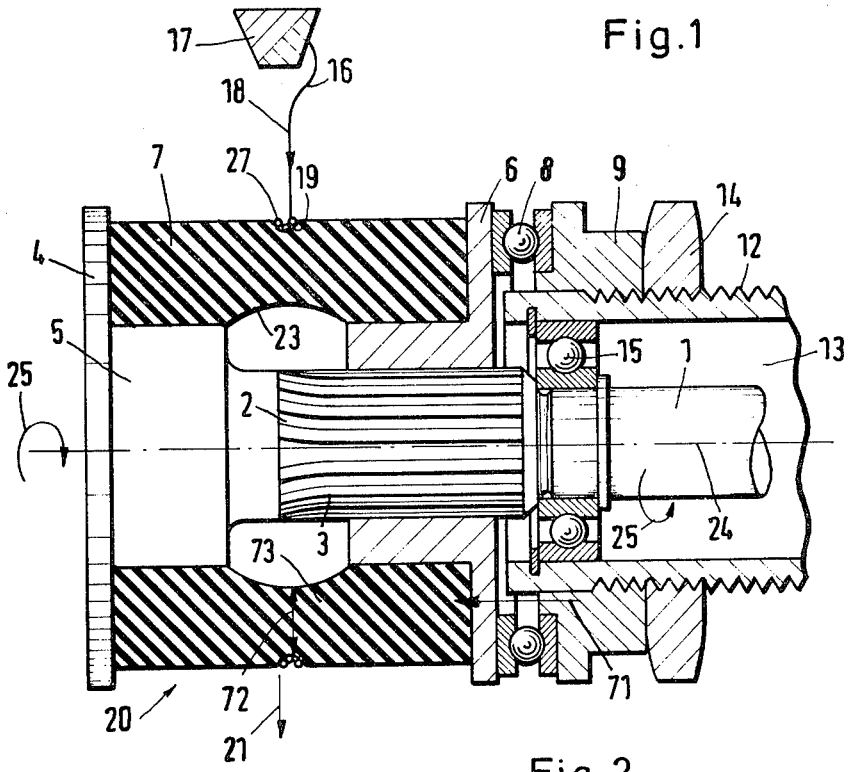

Referring to FIG. 1, the metering drum 20 is constructed and positioned for use, for example, in an air jet weaving machine (not shown). The drum 20 is positioned to receive a filamentary material such as a weft thread 16 from a bobbin 17 for delivery to a working point in the weaving machine in measured lengths.

As shown, the metering drum 20 has an elastically deformable circumferential surface formed by a cylindrical sleeve or jacket 7 of elastic material such as rubber for receiving a plurality of windings 27 of the weft thread 16. In addition, the metering drum 20 has means for deforming the sleeve 7 in order to vary the circumferential dimension thereof whereby the length of the thread delivered from the drum 20 can be varied.

As shown, the metering drum includes a drive shaft 1 which is disposed for rotation about an axis 24 in the direction indicated by the arrow 25 and which is driven from the weaving machine in synchronism therewith. The drive shaft 1 includes a terminal section 2 having a longitudinal serration 3 and an enlarged head 5 at the end.

The means for deforming the sleeve 7 includes a supporting ring 4 which is fixedly disposed on the shaft head 5 and a supporting ring 6 which is mounted on the serration 3 so as to be adjustable axially relative to the ring 4. As indicated, the sleeve 7 is clamped between the supporting rings 4, 6 so that upon movement of the ring 6 toward the ring 4, the sleeve 7 is deformed outwardly to change the outer diameter of the sleeve 7 in the part where the windings 27 are received.

As shown, the axially movable supporting ring 6 abuts a ball thrust bearing 8 which, in turn, is received on a fixedly mounted supporting ring 9. This supporting ring 9 is disposed on a fixedly mounted cylinder 13 which is concentric to the shaft 1 and is held against the bearing 8 by a locking nut 14 which is threaded onto a thread 12 of the cylinder 13. A ball bearing 15 is also provided to rotatably mount the drive shaft 1 within the cylinder 13. As indicated, the bearing 15 has an inner race fixed on the drive shaft 1 and an outer race which is positioned via a locking ring.

During a weaving operation, the weft thread 16 runs off the bobbin 17 which is located outside of the shed of the weaving machine in the direction indicated by the arrow 18 into a circumferential groove 19 in the sleeve 7. As indicated, a plurality of windings 27, for example 3 or 4 windings are formed within the groove 19. Thereafter, the weft thread is delivered in the direction indicated by the arrow 21 to a working point of the weaving machine, for example a weft thread magazine (not shown) and subsequently to a picking mechanism (not shown) for insertion into the shed of the weaving machine.

Figure 2:
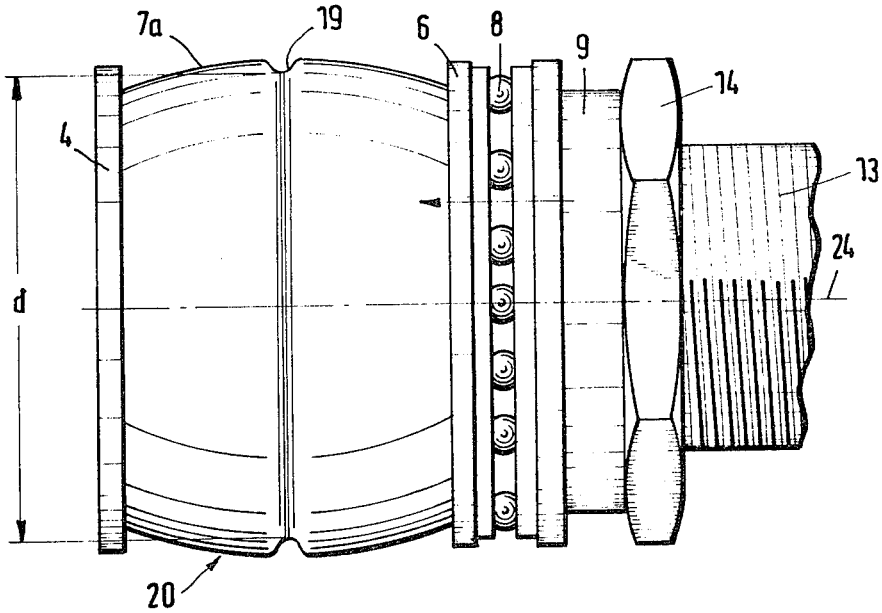
FIG. 2 illustrates a front view of the metering device of FIG. 1 with a deformable sleeve in an expanded state in accordance with the invention.

If the length of a thread pulled off the bobbin 17 by the metering drum 20 per weaving machine cycle is not sufficient for the weaving width adjusted on the weaving machine, the locking nut 14 is turned during operation so that the rings 9, 6 are moved to the left as indicated by the arrow 71 in FIG. 1. This causes the supporting rings 4, 6 to upset the sleeve 7 into an expanded condition as indicated in FIG. 2 such that the diameter d of the groove 19 is enlarged. As a result, the length of each thread winding in the groove 19 (not shown in FIG. 2) and, hence, the delivered length of the weft thread becomes greater. Any desired thread length to be drawn off the bobbin 17 can be adjusted during weaving via the nut 14. Hence, an optimum operation can be achieved and a minimum amount of thread scrap results on the catching side of the weaving machine.

As indicated in FIG. 1, the sleeve 7 may be provided with a recess 23 on the inner circumference so that a neck down portion 73 of smaller cross-section is formed at the mid-section of the sleeve 7 in order to insure that the sleeve 7 moves outwardly at the mid-section.

Figure 1A:
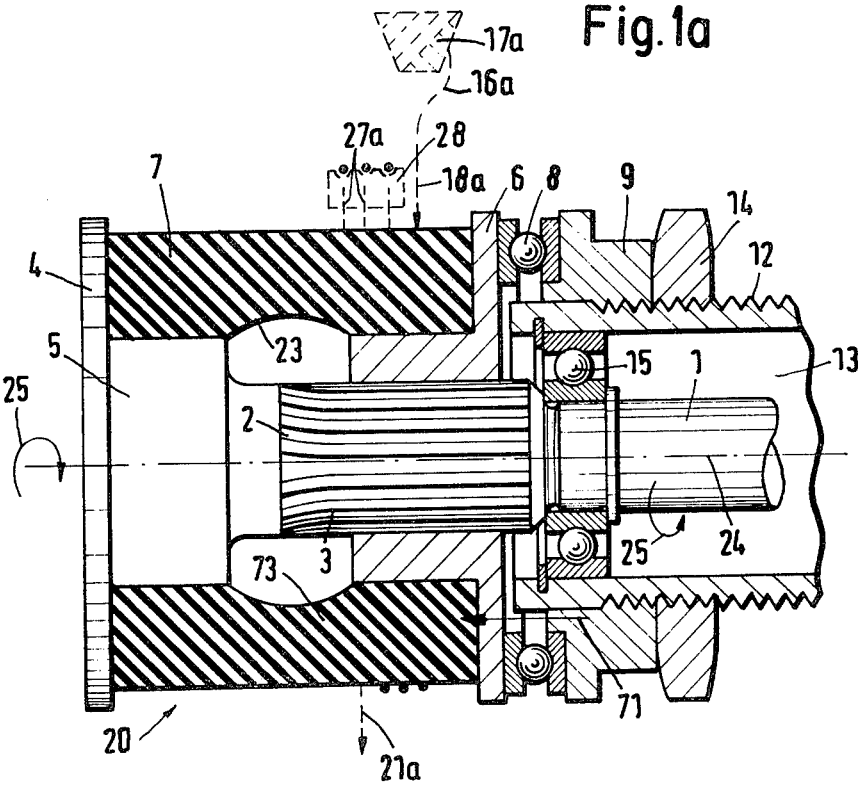

As indicated in broken lines in FIG. 1*a*, wherein like reference characters indicate parts as above, the thread windings 27*a* of a weft thread 16*a* drawn off a bobbin 17*a* in the direction indicated by the arrow 18*a* and delivered as indicated by the arrow 21*a* may be separated by means of a comb 28 disposed outside the sleeve 7. The comb 28 insures that the windings do not run one over the other. In this case, the groove 19 is omitted. Of note, the comb 28 may be arranged anywhere opposite the sleeve 7 as indicated in FIG. 1*a* or may be disposed at the center of the sleeve, i.e. approximately opposite the position of the groove 19.

Figure 3:
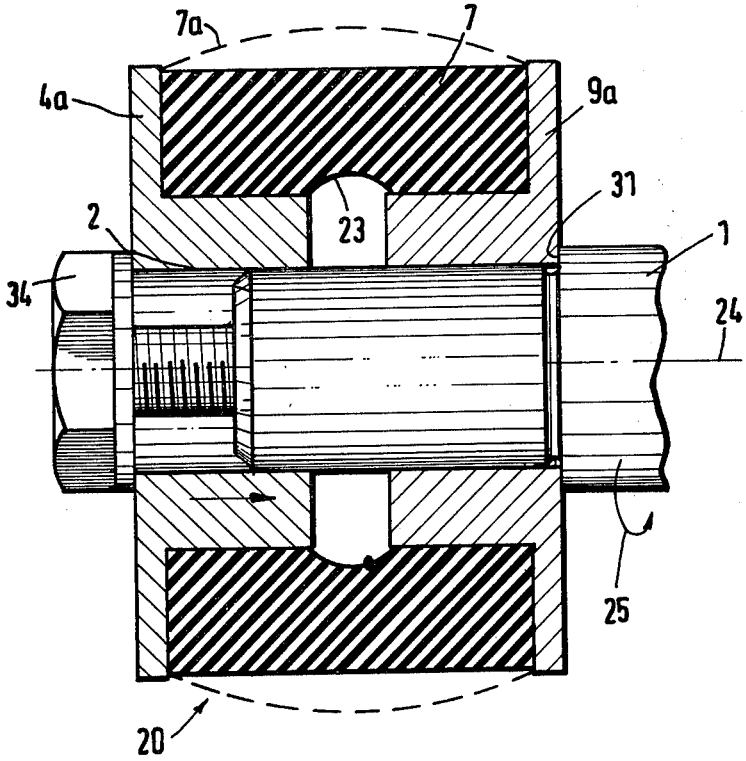
FIG. 3 illustrates a part-cross-sectional side view of a modified metering drum according to the invention having coaxially movable supporting rings for the deformable sleeve.

Referring to FIG. 3, wherein like reference characters indicate like parts as above, the supporting rings 4*a*, 9*a* may be fixedly mounted on an end portion 2 of the drive shaft 1 against a shoulder 31. As above, the elastically deformable sleeve 7 is disposed between the supporting rings 4*a*, 9*a*. In addition, an adjusting screw 34 is threaded into the end face of the drive shaft 1 and abuts against the outermost supporting ring 4*a*. Upon threading of the screw 34 into the shaft 1, the supporting rings 4*a*, 9*a* are brought closer together so that the sleeve 7 is expanded into the shape indicated in dotted line 7*a*.

As indicated in FIG. 3, the supporting rings 4*a*, 9*a* and the screw 34 rotate with the shaft 1. Hence, deformation of the sleeve 7 can be carried out only when the metering drum 20 stands still.

Figure 4:
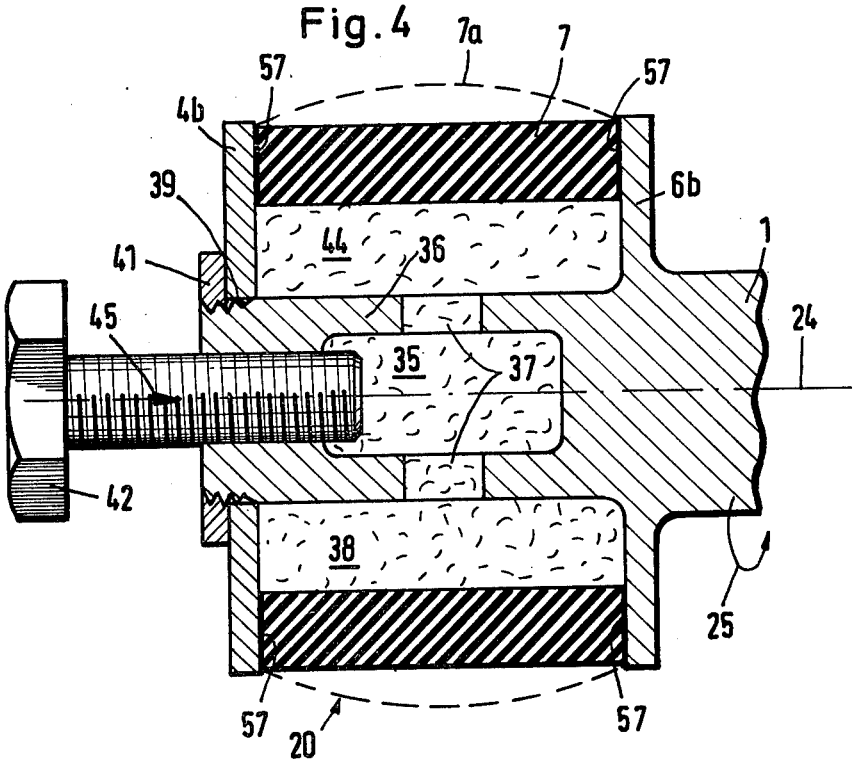
FIG. 4 illustrates a part cross-sectional side view of an embodiment of a metering device employing a displaceable pressure medium in accordance with the invention.

Referring to FIG. 4, wherein like reference characters indicate like parts as above, the metering drum may be constructed in a manner such that the supporting rings 4*b*, 6*b* do not move during an adjustment period. As shown, the outermost ring 4*b* is mounted on an extended hollow section 36 of the drive shaft 1 and is held in place via a ring 41 which is threaded onto a thread 39 at the end of the drive shaft 1. The opposite supporting ring 6*b* is integrally formed on the drive shaft 1. The sleeve 7 is also fixed to the supporting rings 4*b*, 6*b* for example by being vulcanized thereon so as to be held in nonrotatable relation along the surfaces 57. In addition, the supporting rings 4*b*, 6*b* and sleeve 7 define a chamber 38 with the drive shaft 1 while the hollow section 36 of the drive shaft 1 has a cavity 35 which communicates with the chamber 38 via two bores 37. The cavity 35 and chamber 38 are filled with a pressure medium 44 while a means in the form of a screw 42 is provided for displacing the medium 44 within the chamber 38 in order to expand the sleeve 7 into the position indicated in dotted line 7*a*. As shown, the screw 42 is threaded into the drive shaft 1 on the axis 24 and passes into the cavity 35.

During operation, the sleeve 7 is initially in the position shown in full line with a circumferential surface coaxial to the axis 24 of the drive shaft 1. When the sleeve 7 is to be expanded, the screw 42 is threaded into the hollow section 36 of the drive shaft 1 and the pressure medium 44, for example a viscous paraffin or wax, is pressurized so that the sleeve bulges or expandes outwardly to the position indicated by the dotted line 7*a*. In this position, the thread windings (not shown) have a greater circumferential length.

Figure 5:
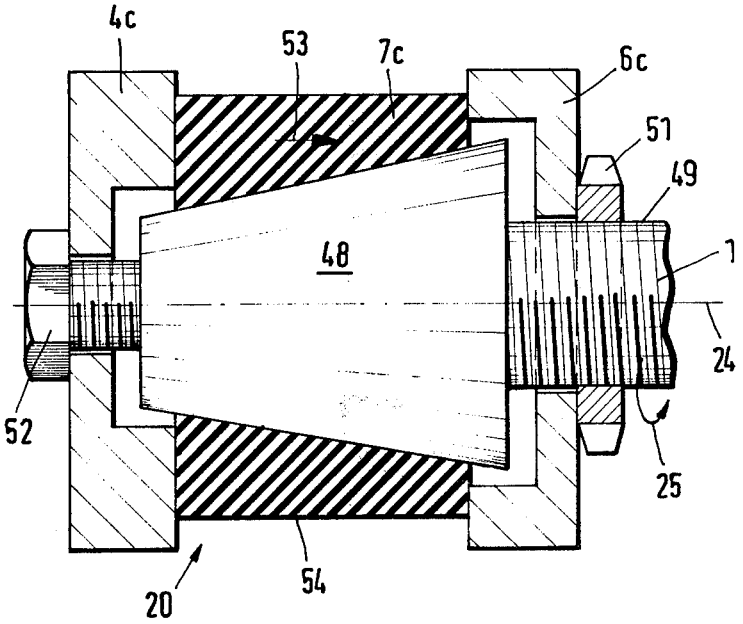
FIG. 5 illustrates a part cross-sectional side view of a further embodiment of a metering device employing a tapered section of a drive shaft for mounting an axially shiftable elastic sleeve.

Referring to FIG. 5 wherein like reference characters indicate like parts as above, the drive shaft 1 has a tapered section 48 which slidably receives a sleeve 7*c* having a cylindrical outer surface 54 and a conically tapered inner surface which is matingly received on the tapered section 48. Further, one supporting ring 4*c* abuts one side of the sleeve 7*c* and is carried via a screw 52 which is threaded into the tapered section 48 while a second supporting ring 6*c* abuts the other side of the sleeve 7*c*. This latter supporting ring 6*c* is mounted about the drive shaft 1 and is abutted by a locking nut 51 which is threaded onto a thread 49 on the drive shaft 1.

In order to adjust the circumferential length of a thread winding (not shown) on the sleeve *7c*, the locking nut 51 is threaded to the right as viewed in FIG. 5. Thereafter, the screw 52 is threaded farther into the tapered section 48 so that the sleeve *7c* is shifted to the right as indicated by the arrow 53. In so doing, the sleeve *7c* is expanded due to the conical shape of the tapered surface 48 and the inner surface of the sleeve *7c*. During this time, the outer circumferential surface 54 of the sleeve *7c* remains in a parallel, coaxial position to the axis 54 of the drive shaft 1. However, this adjustment can be made only when the drum 20 is standing still.

Figure 7:
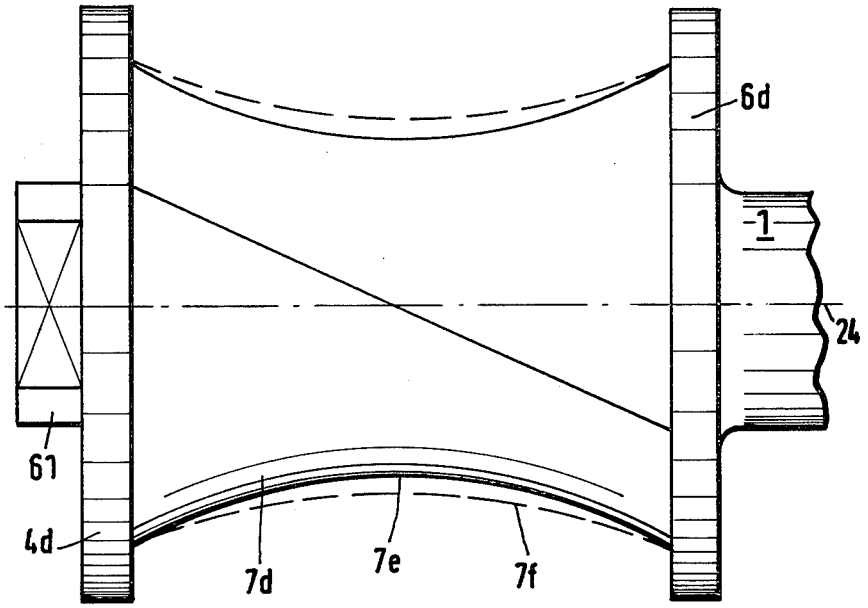
FIG. 7 illustrates a view similar to FIG. 6 of the elastic sleeve in a constricted state.
Figure 6:
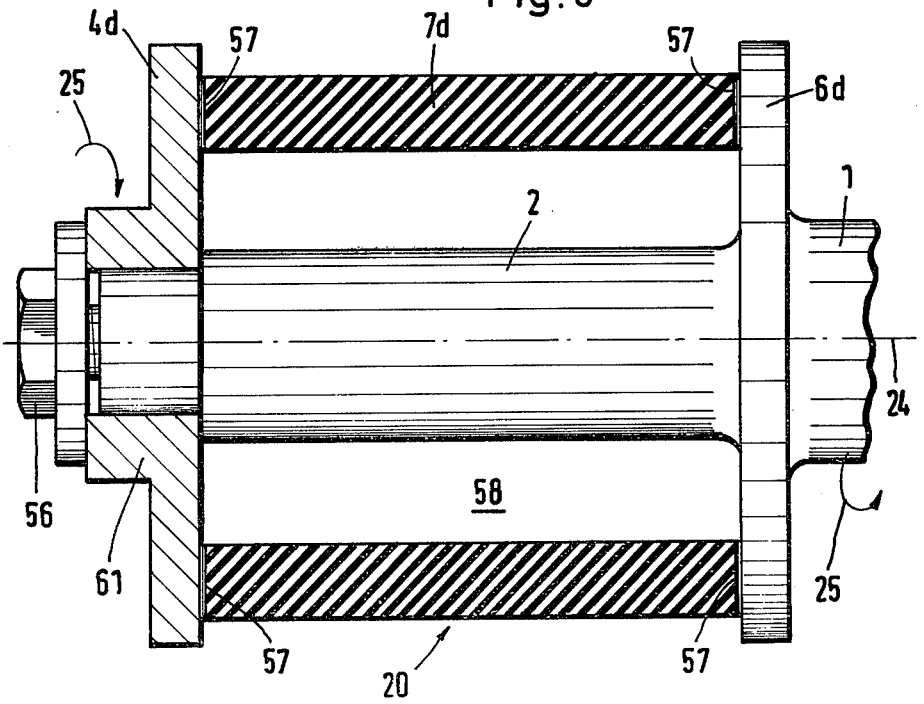
FIG. 6 illustrates a part cross-sectional view of a metering device employing relatively rotatable supporting rings for constricting an elastic sleeve in accordance with the invention.

Referring to FIGS. 6 and 7 wherein like reference characters indicate like parts as above, the metering drum 20 can be constructed so that the elastic sleeve *7d* can be constricted to reduce the length of a thread winding. As indicated, the supporting rings *4d*, *6d* are fixedly mounted on the drive shaft 1. For example, the outer ring *4d* is abutted against a shoulder on the central portion 2 of the drive shaft 1 while the other ring *6d* is integrally formed with the drive shaft 1. In addition, a bolt 56 is threaded into the drive shaft 1 to hold the outer ring *4d* in place. The sleeve *7d* is concentrically spaced about the drive shaft 1 so as to define an annular cavity 58 therebetween. In addition, the sleeve *7d* is secured, as by vulcanization, at the surfaces 57 to the supporting rings *4d*, *6d*.

In order to adjust the diameter of the sleeve *7d*, the support ring *4d* is provided with a square head 61. During an adjustment, the bolt 56 is first unthreaded to loosen the supporting ring *4d*. Next, a tool is applied on the square head 61 and the ring *4d* is rotated relative to the integrated ring *6d*. This causes a torsion or twisting to occur in the elastic sleeve *7d* so that the sleeve *7d* is constricted into the position *7e* indicated in solid line or the position *7f* as indicated in broken line. When the desired diameter is achieved, the bolt 56 is tightened so that the supporting ring *4d* maintains the new position. Of note, the diameter of the sleeve *7d* can be changed only when the metering drum is standing still.

In all of the described embodiments, the circumferential surface of the metering drum which receives the thread windings consists of an elastically deformable or flexible material while suitable means are provided for expanding or constricting the deformable part. Of note, the entire circumferential surface of the drum need not be made of elastic material. Instead, only a section of the circumferential surface carrying the windings 27 need be elastically deformable. The remaining sections may be rigid and may consist of a metallic material.

The invention thus provides a metering drum having a circumferential surface which can be varied in diameter from time to time in order to change the length of a thread being delivered from the drum. The invention further provides a relatively simple means of adjusting the circumferential surface of the drum.

What is claimed is:

1. A metering drum for a filamentary material having a circumferential surface for receiving at least one winding of filamentary material thereon, at least a part of said surface being elastic for varying of the circumferential dimension thereof, a drive shaft, a first supporting ring fixedly mounted on said drive shaft, a second supporting ring movably mounted on said drive shaft with said elastic part disposed between said rings, a fixed cylinder concentric to said shaft and having an external thread, a bearing rotatably mounting said shaft in said cylinder, a third ring threaded on said cylinder and a bearing between said second ring and said third ring whereby threading of said third ring on said cylinder adjusts said second ring relative to said first ring for changing the diameter of said elastic part.

* * * * *